US006041529A

United States Patent [19]

Ruvang

[11] Patent Number: 6,041,529

[45] Date of Patent: Mar. 28, 2000

[54] BOLT-ON WEAR RUNNER ASSEMBLY FOR MATERIAL HANDLING/DISPLACEMENT APPARATUS

[75] Inventor: John A. Ruvang, Hickory Creek, Tex.

[73] Assignee: G. H. Hensley Industries, Inc., Dallas, Tex.

[21] Appl. No.: 09/040,587

[22] Filed: Mar. 18, 1998

[51] Int. Cl.[7] ..... E02F 9/28

[52] U.S. Cl. ..... 37/446; 172/445.1; 172/772

[58] Field of Search ..... 37/446, 451, 455, 37/456, 450, 460; 172/445.1, 772, 701.3, 501, 684.5, 719, 797

[56] References Cited

U.S. PATENT DOCUMENTS

| | | | |
|---|---|---|---|
| 1,885,231 | 11/1932 | Chong et al. . | |
| 2,841,896 | 7/1958 | Meshorer | 37/142 |
| 3,028,696 | 4/1962 | Whisler, Sr. | 37/141 |
| 3,197,895 | 8/1965 | Cooke | 37/143 |
| 3,462,861 | 8/1969 | Kampert | 37/142 |
| 3,845,578 | 11/1974 | Holmstrom | 37/455 |
| 3,851,413 | 12/1974 | Lukavich | 37/141 T |
| 4,052,803 | 10/1977 | Lanz et al. | 37/141 T |
| 4,180,926 | 1/1980 | Klett et al. | 37/456 |
| 4,668,122 | 5/1987 | Riddle | 404/121 |
| 4,995,176 | 2/1991 | Briscoe et al. | 37/141 R |
| 5,077,918 | 1/1992 | Garman | 37/141 T |
| 5,088,214 | 2/1992 | Jones | 37/141 R |
| 5,224,555 | 7/1993 | Bain et al. | 172/772.5 |
| 5,241,765 | 9/1993 | Jones et al. | 37/398 |
| 5,471,770 | 12/1995 | Ferreira | 37/264 |
| 5,913,605 | 6/1999 | Jusselin et al. | 37/451 |

*Primary Examiner*—Thomas B. Will
*Assistant Examiner*—Robert E. Pezzuto
*Attorney, Agent, or Firm*—Konneker & Smith, P.C.

[57] ABSTRACT

A wear runner assembly is attached to a surface of an excavating bucket and serves to protect a portion of the surface from abrasion wear during use of the bucket. The assembly includes a base member, a wear runner member, a pair of bolts and a pair of conical locking nuts. The base member is welded to the surface and has a pair of undercut slots that captively retain the head portions of the bolts, with the bolt bodies being transverse to the surface and projecting outwardly beyond the outer side of the base member. The wear runner member is mounted on the base member by moving the wear runner member toward the base member in a direction transverse to the surface in a manner causing the outwardly projecting bolt body portions to enter and be recessed within a pair of openings formed through the wear member, and also causing projections on the base member to be complementarily received within recesses formed in the wear runner member. Finally, conical locking nuts are threaded onto the bolt bodies recessed within the wear runner member openings to releasably hold the wear runner member on the base member. The interlock between the base member projections and the wear runner member recesses prevents operating loads imposed on the assembly from moving the wear runner member relative to the base member parallel to the protected surface to thereby prevent the bolts from being sheared by such operating loads.

20 Claims, 3 Drawing Sheets

BOLT-ON WEAR RUNNER ASSEMBLY FOR MATERIAL HANDLING/DISPLACEMENT APPARATUS

BACKGROUND OF THE INVENTION

The present invention generally relates to earth working apparatus and, in a preferred embodiment thereof, more particularly relates to wear runner structures for inhibiting surface abrasion wear on earth working apparatus such as, for example, excavating buckets and the like.

Wear runner assemblies are commonly installed on various surfaces of earth working structures, such as excavating buckets, to inhibit abrasion wear on such surfaces during use of the earth working structures. A typical wear runner assembly includes a base which is welded or otherwise anchored to the surface to be shielded from abrasion wear, and a wear runner member or shroud which is positioned over the base and releasably interlocked therewith. To hold the wear member on the base during use of the earth working structure, a separate locking mechanism is used to fasten the wear member to the base and maintain the wear member in an interlocked relationship with the base until removal of the wear member from the base is desired.

Various problems, limitations and disadvantages have typically been associated with wear member/base locking mechanisms of conventional construction. For example, some conventional locking mechanisms must be forcibly struck to dislodge them, thereby creating a potential safety hazard. Other types of conventional locking mechanisms can be dislodged during earth working operations, thereby causing the wear member to fall off its underlying base structure, or can seize up in a manner requiring them to be burned off to permit removal of the wear runner from its associated base. Additionally, many locking mechanisms tend to be tedious and time-consuming to remove and install. Still other types of conventional locking mechanisms, such as bolts extended through the wear runner, the base, and the underlying earth working structure wall, undesirably require access to opposite sides of the earth working structure wall for installation and removal of the wear runner, and additionally can weaken the earth working structure wall due to the necessity of forming a series of bolt holes therein.

As can readily be seen from the foregoing, a need exists for an improved wear runner assembly which eliminates or at least substantially reduces the above-mentioned problems, limitations and disadvantages commonly associated with conventional wear runner assemblies. It is accordingly an object of the present invention to provide such an improved wear runner assembly.

SUMMARY OF THE INVENTION

In carrying out principles of the present invention, in accordance with a preferred embodiment thereof, a specially designed wear runner assembly is provided which is useable to protect a portion of a surface, for example a surface of a material handling apparatus such as an excavating bucket, from abrasion wear.

From a broad perspective, the wear runner assembly comprises a base member having an inner side securable to the surface to be protected, and an outer side opposite the inner base member side. A wear member portion of the assembly is mountable on the base member by moving the wear member transversely toward the outer side of the base member. To releasably hold the wear runner member on the base member, a fastening structure is provided. Such fastening structure in positionable entirely outwardly of the surface and preferably includes a fastening member extendable through the wear member and the base member along an axis transverse to the surface portion to be protected.

The base member and the wear member have interlockable portions which, with the inner side of the base member secured to the surface and the wear member mounted on the base member, are operative to prevent appreciable movement of the wear member relative to the base member parallel to the surface to thereby permit operating loads imposed on the wear member parallel to the surface from causing the wear member to shear the fastening member.

In a preferred form of the wear runner assembly, the fastening member is a bolt, and an undercut slot is formed in the base member and captively retains the head portion of the bolt, in response to moving the bolt through the slot in a direction parallel to the surface to which the base member is secured, in a manner causing the body of the bolt to extend transversely to the surface and project outwardly beyond the outer side of the base member. As the wear member is mounted on the base member, by moving the wear member transversely to the outer side of the base member (and thus transversely to the surface portion to which the base member is secured), the projecting bolt body portion enters and is recessed within an opening formed through the wear member. To complete the installation of the assembly, a conical locking nut is positioned in such opening and threaded onto the bolt body in a manner causing the annular tapered underside of the nut to forcibly engage a corresponding tapered annular portion of the wear member opening. The bolt and nut are thus positioned entirely outwardly of the surface portion to which the assembly is secured, thereby eliminating the necessity of forming bolt holes through the surface.

According to other features of the invention, the inner end of the undercut slot is configured to complementarily engage a side edge portion of the bolt head in a manner preventing the bolt from rotating relative to the base member as the nut is being threaded onto the bolt body. Additionally, a wear indicator recess is preferably formed on the underside of the wear member. As the outer side of the wear member is worn away by operational abrasion it eventually wears away the outer side portion over the recess to thereby give the operator a visual indication that it is time to remove the worn wear member and replace it with another one.

DETAILED DESCRIPTION

Referring initially to FIGS. 1–5, the present invention provides a specially designed bolt-on wear runner assembly 10 which is securable to a surface, such as a lower side surface 12 of a metal excavating bucket 14, to protect the surface 12 from earth abrasion wear during use of the excavating bucket 12. While the wear runner assembly 10 is representatively shown as being used in conjunction with an excavating bucket, it will be readily appreciated by those of skill in this particular art that it could also be used in a variety of other surface-protecting applications such as, for example, on other types of material handling or displacement apparatus, on truck bed liners and on other types of surfaces subject to wear during use of their associated structures.

Figure 7:
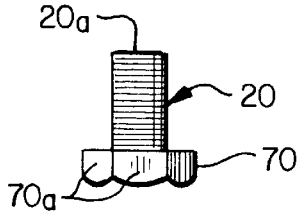
FIG. 7 is a side elevational view of one of the bolts used to releasably secure the wear runner to the underlying base portion of the assembly.
Figure 8:
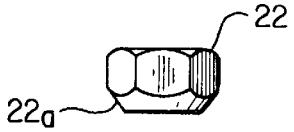
FIG. 8 is a side elevational view of one of the conical locking nuts used in conjunction with the bolts.

The wear runner assembly 10 is of a very simple construction and includes an elongated rectangular metal weld base member 16 (see FIGS. 2, 3, 5 and 6); an elongated rectangular metal wear runner member 18 (see FIGS. 1–4); two bolts 20 (see FIG. 7); and two conical locking nuts 22 (see FIG. 8).

Figure 3:
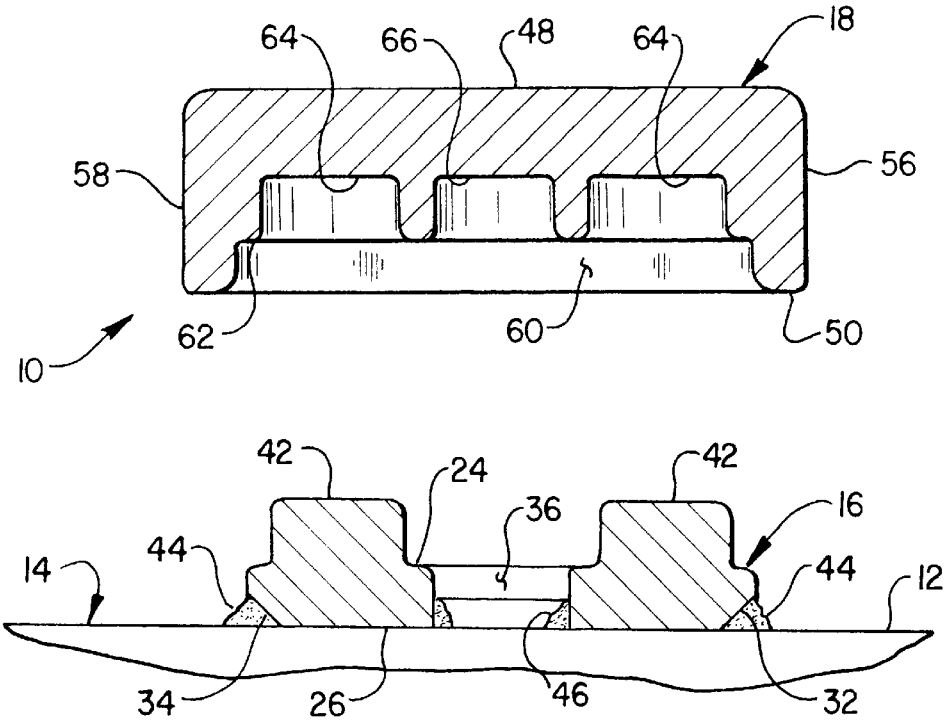
FIG. 3 is an exploded cross-sectional view of the wear runner assembly taken along line 3—3 of FIG. 1.
Figure 4:
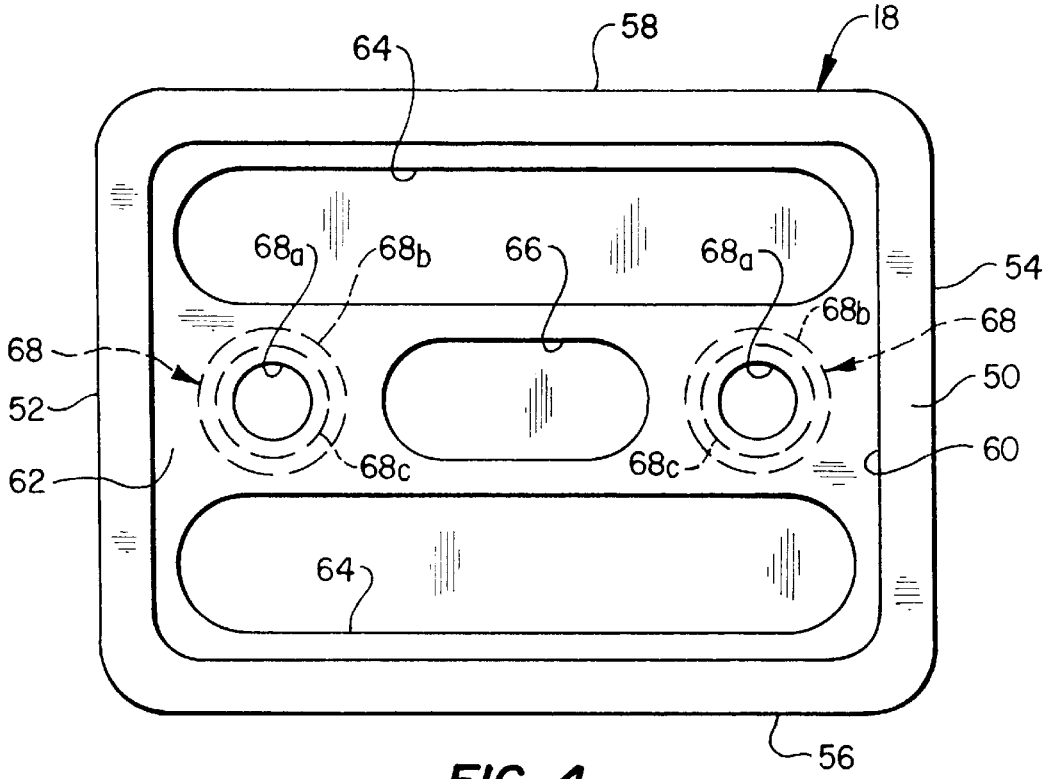
FIG. 4 is a bottom plan view of the wear runner portion of the assembly.
Figure 5:
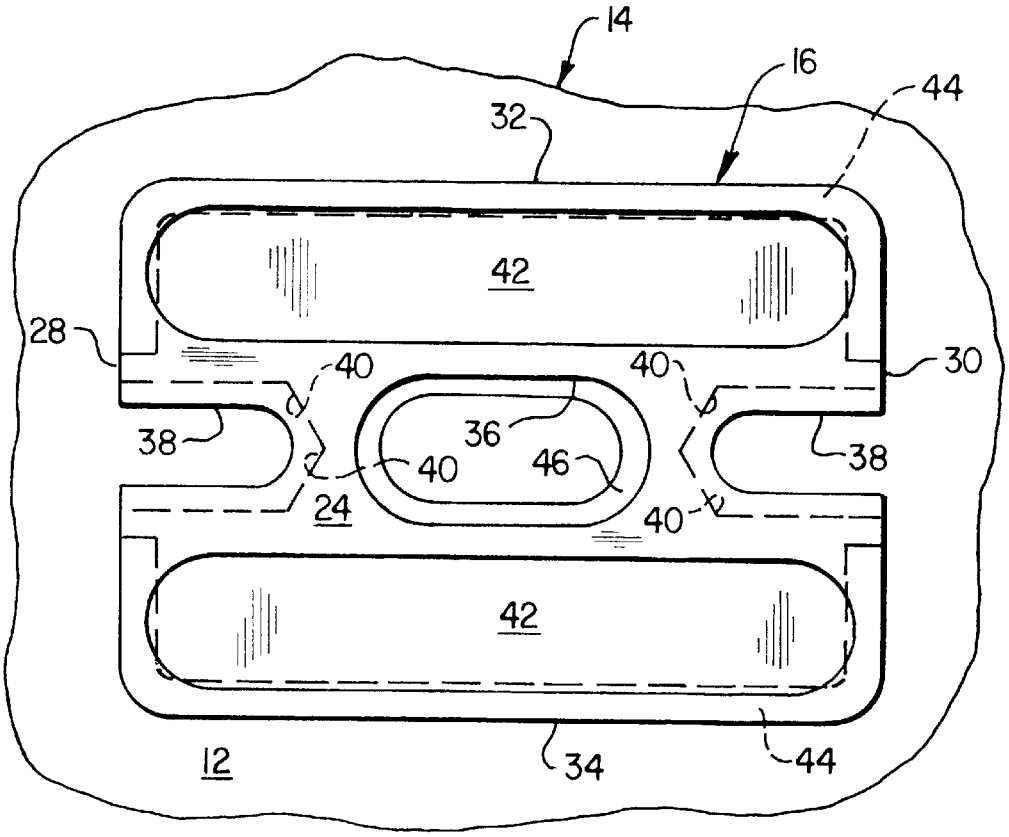
FIG. 5 is a top plan view of the base portion of the assembly with the wear runner portion thereof having been removed.
Figure 6:
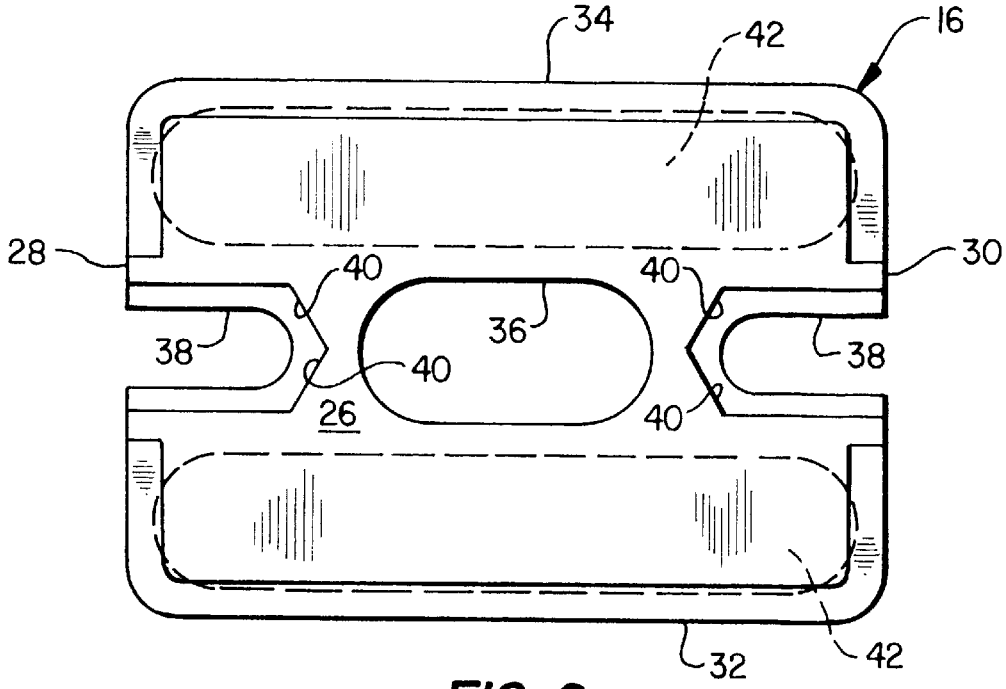
FIG. 6 is a bottom plan view of the base portion.

As illustrated in FIGS. 3, 5 and 6, weld base member 16 has a top or outer side 24, a bottom or inner side 26, a pair of opposite ends 28 and 30 which define opposite edge surfaces of the base member, a pair of opposite undercut side edge portions 32 and 34, a central opening 36, and a pair of undercut slots 38 extending inwardly from its opposite ends 28 and 30. For purposes later described herein, each of the undercut inner ends of the slots 28 have a pair of angled faces 40 formed thereon. Additionally, the weld base member 16 has a pair of elongated upstanding locator boss portions 42 formed on its top side 24 and extending parallel to its length and positioned on opposite sides of its central opening 36 and its undercut slots 38.

As illustrated in FIGS. 3 and 5, to ready the assembly 10 for operative installation on the surface 12, the bottom side 26 of the base member 16 is welded to the surface 12 using welds 44 disposed along the undercut side edge portions 32 and 34, and a weld joint 46 extending around a lower edge periphery of the central opening 36.

The wear runner member 18, as best illustrated in FIGS. 1–4, has a slightly larger elongated rectangular configuration than that of the weld base member 16 and has a top or outer side 48; a bottom side 50; opposite ends 52 and 54; opposite sides 56 and 58 extending between the ends 52 and 54; and a generally rectangular bottom side recess 60 configured to complementarily receive the weld base member 16 as later described herein. Bottom side recess 60 has an inner side surface 62 in which are formed a pair of elongated depressions 64 each configured to complementarily receive one of the weld base member locator bosses 42.

As illustrated, the elongated depressions 64 are longitudinally parallel to and positioned adjacent the opposite sides 56 and 58 of the wear runner member 18. Centrally positioned between and longitudinally extending parallel to the depressions 64 is an elongated wear indicator recess 66. A pair of circularly cross-sectioned openings 68 are formed through the wear runner member 18 between the depressions 64 at opposite ends of the wear indicator recess 66. As best illustrated in FIG. 2, each opening 68 has a relatively small diameter lower portion 68*a* extending upwardly from the inner side surface 62 of the bottom side recess 60, a diametrically enlarged upper portion 68*b* extending upwardly through the top side 48 of the wear runner member 18, and an annular, downwardly and inwardly sloped intermediate surface portion 68*c* positioned between the opening portions 68*a*,68*b*.

With the base member welded to the surface 12 as illustrated in FIGS. 3 and 5, the bolts 20, with their hexagonally shaped heads 70 facing downwardly, are slid into the undercut base member slots 38 until the vertically oriented bolt bodies 20*a* reach the inner ends of the slots 38 and contiguous pairs of angled side edge surfaces 70*a* of the bolt heads 70 (see FIG. 7) complementarily engage the two angled inner end faces 40 (see FIGS. 5 and 6) of their associated undercut slots 38. With the bolts 20 in this position, upper end portions of their bodies 20*a* project upwardly through the undercut slots 38 as best illustrated in FIG. 2.

Figure 1:
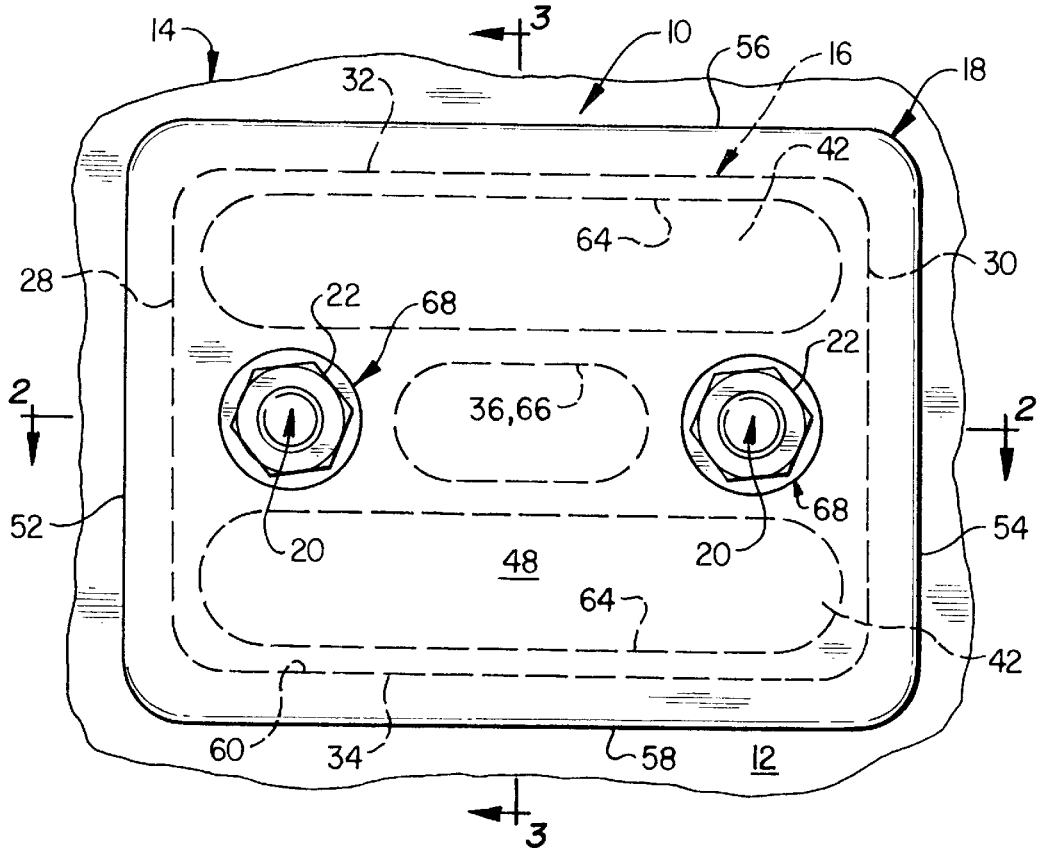
FIG. 1 is a top plan view of a specially designed bolt-on wear runner assembly embodying principles of the present invention and being operatively secured to a surface to be protected from abrasion wear, representatively a side surface of an excavating bucket.
Figure 2:
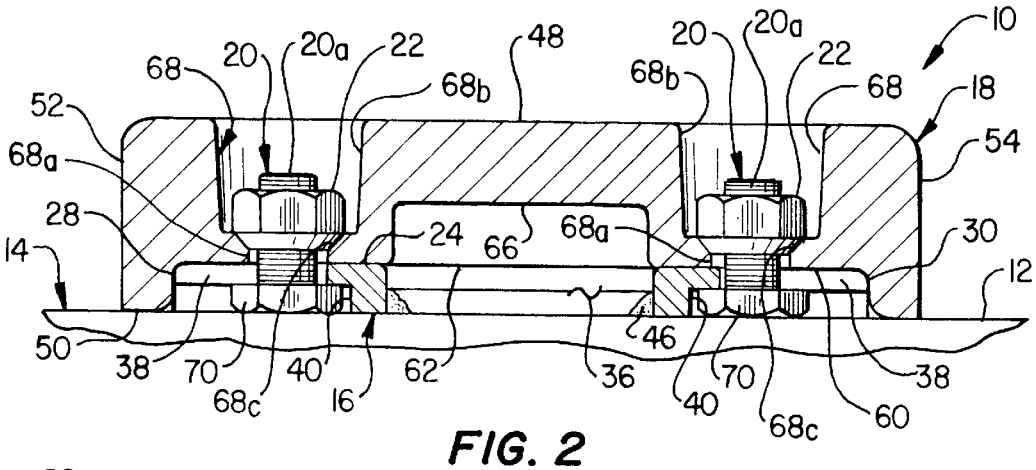
FIG. 2 is a cross-sectional view through the wear runner assembly taken along line 2—2 of FIG. 1.

Next, the wear runner member 18, bottom side down, is placed over the base member 16 (see FIG. 2) in a manner such that the wear runner member 18 is downwardly telescoped over the base member 16 with the bottom side 50 of the wear member 18 being contiguous with the surface 12, the base member locator bosses 42 being upwardly and complementarily received in the wear runner member depressions 64 (see FIG. 3), the wear indicator recess 66 overlying the central opening 66 in the base member, and upper end portions of the bolt bodies 20*a* extending upwardly through the circularly cross-sectioned wear runner member opening portions 6*a*,68*c* into the opening portions 68*b* as best illustrated in FIG. 2.

Finally, the nuts 22 are tightened onto the upper ends of the bolt bodies 20*a*, which are downwardly recessed into the upper wear runner member opening portions 68*b* so that the conically tapered annular side surfaces 22*a* (see FIG. 8) of the nuts 22 firmly engage the complementarily shaped sloping annular surfaces in the wear runner member opening portions 68*c*. This operation removably positions the wear runner member 18 on the weld base member 16 in a manner shielding a portion of the surface 12 from abrasion wear. The previously described engagement of the pairs of bolt head surfaces 70*a* (see FIG. 7) with the facing angled pairs of slot end surfaces40 (see FIGS. 5 and 6) advantageously prevent the bolts from rotating while the nuts 22 are being operatively threaded onto the bolt bodies 20*a*.

Operational forces imposed on the installed wear runner member 18 parallel to the surface 12 (which would otherwise tend to simply shear the bolt bodies 20*a*) are borne by the base member 42 locator bosses 42. Thus, a simple bolt-on installation of the wear runner member 18 is achieved in which the installation movement of the wear runner member 18 is transverse to the surface 12 to be protected. Conventional wear runner members are slid onto their underlying weld bases (typically using a dovetail joint therebetween) in a direction parallel to the surface 12. This undesirably requires that a substantial gap be left between adjacent pairs of wear runner assemblies. However, in the present invention, adjacent pairs of wear runner assemblies 10 may be essentially butted up against one another since the wear runner members are installed transversely to the surface 12 to be protected instead of in a direction parallel thereto.

Another advantage provided by the wear runner assembly 10 compared to conventional wear runner assemblies is that it not necessary in the present invention to form bolt holes in the portion of the excavation bucket 14 (or other apparatus) on which the surface 12 to be protected is disposed. In other words, the bolts 20 need not extend through any portion of the bucket—the bolts 20 are installable instead by sliding them parallel to the surface into the base member slots 38. This elimination of the need to form bolt holes in the excavating bucket also eliminates the resulting weakening of the portion of the bucket in which the bolt holes are formed, eliminates the necessity of providing access to the opposite side of the bucket portion on which the assembly 10 is mounted to operatively pass the bolts through the bolt holes in the bucket structure, and also makes the installation of the wear runner member 18 an appreciably faster and easier process.

As the top side 48 of the installed wear runner member 18 is being worn away, the countersunk nuts 22 and upper bolt body ends are shielded from abrasion wear. When abrasion wears away a sufficient portion of the top side of the wear runner member 18, the interior of the wear indicator recess 66 is exposed to thereby give the operator a visual indication that it is time to remove and replace the worn wear runner member 18. This is done by simply removing the nuts 22 and pulling the worn wear runner member 18 off the underlying base member 16 in a direction perpendicular to the surface 12. The top side of the wear indicator recess 66 may, as shown, be positioned generally level with the top ends of the bolt bodies 20*a* or slightly above the top ends of the bolt bodies 20*a*.

While the illustrated wear runner member 18 is illustrated as being removably held on the underlying base member 16 by a pair of bolts 20, it will be readily appreciated by those of skill in this particular art that a greater or fewer number of bolts or other types of fastening structures could alternatively be utilized for this purpose if desired.

As but one example of an alternate fastening structure useable to releasably retain the wear runner 18 on the underlying base member 16, the undercut slots 38 could be eliminated, and threaded openings formed in the base member 16 and positioned to underlie the wear runner member opening portions 6*a*. Bolts (not shown) could then be extended downwardly through the wear runner member openings 68 and threaded into the underlying threaded openings in the base member 16. Like the use of the illustrated bolt and nut sets 20,22 this would provide fastening means which are positioned entirely outwardly of the surface 12 and are operative to releasably hold the wear runner 18 on the underlying base member 16.

The foregoing detailed description is to be clearly understood as being given by way of illustration and example only, the spirit and scope of the present invention being limited solely by the appended claims.

What is claimed is:

1. Apparatus for protecting a surface from wear, comprising:

a base member having an inner side securable to the surface, and an outer side opposite said inner side;

an opening formed in said base member for receiving a head portion of a bolt moved through said opening in a direction parallel to said inner side, and for captively retaining the received bolt head portion in an orientation in which the body of the bolt longitudinally extends transversely to said inner side and outwardly through said opening past said outer side;

a wear member having an opening therein and being mountable on said base member by moving said wear member transversely toward said outer side of said base member in a manner causing the body of the bolt to extend through said wear member opening for connection to a retaining nut to releasably prevent removal of said wear member from said base member in a direction transverse to said inner side; and cooperating structures on said base member and said wear member for interlocking the wear member with said base member in a manner preventing appreciable movement of the wear member relative to said base member parallel to said inner side of said base member.

2. The apparatus of claim 1 wherein said cooperating means include:

a recess formed in one of said base member and said wear member, and a projection formed on the other of said base member and said wear member and being complementarily receivable in said recess.

3. The apparatus of claim 2 wherein:

said recess is formed in said wear member, and said projection is formed on said base member.

4. The apparatus of claim 1 wherein:

said opening in said base member is an undercut slot formed in said base member, longitudinally extending parallel to said outer side, and laterally opening outwardly through said outer side of said base member.

5. The apparatus of claim 4 wherein:

said base member has a side edge portion extending between said inner and outer sides, and said undercut slot opens outwardly through said side edge portion.

6. The apparatus of claim 4 wherein:

said undercut slot has an inner end configured to complementarily engage a side edge surface area of the bolt head portion in a manner inhibiting rotation of the bolt about its longitudinal axis relative to said base member.

7. The apparatus of claim 1 wherein:

said opening in said base member is positioned thereon to underlie said opening in said wear member when said wear member is mounted on said base member.

8. The apparatus of claim 7 wherein:

said opening in said wear member has a tapered annular portion positioned and configured to be forcibly engaged by a complementarily configured tapered annular side portion of a conical nut operatively threaded onto the bolt body.

9. The apparatus of claim 1 wherein:

said wear member has an outer side, and an inner side with a wear indicator recess formed thereon.

10. Apparatus for protecting a surface from wear, comprising:

a base member having an inner side securable to the surface, and an outer side opposite said inner side;

a bolt having a body portion with a first end, and a second end having a head portion thereon;

said base member having a first opening therein configured to captively retain said head portion of said bolt on said base member, with said body portion of said bolt extending transversely to said inner side and said first end of said bolt positioned outwardly of said outer side, in response to movement of said head portion through said first opening in a direction generally parallel to said inner side;

a wear member having a second opening therein, said wear member being mountable on said base member by moving said wear member transversely toward said outer side of said base member in a manner causing said first end of the bolt to extend through said second opening, said base member and said wear member having cooperating portions thereon which interlock, in a manner restraining movement of said wear member relative to said base member parallel to said inner side, in response to mounting of said wear member on said base member; and a nut threadable onto said first end of said bolt to releasably prevent removal of said wear member from said base member in a direction parallel to said body portion of the captively retained bolt.

11. The apparatus of claim 10 wherein said cooperating portions include:

a recess formed in one of said base member and said wear member, and a projection formed on the other of said base member and said wear member and being complementarily receivable in said recess.

12. The apparatus of claim 11 wherein:

said recess is formed in said wear member, and said projection is formed on said base member.

13. The apparatus of claim 10 wherein:

said first opening is defined by an undercut slot formed in said base member, longitudinally extending parallel to said outer side of said base member, and laterally opening outwardly through said outer side of said base member.

14. The apparatus of claim 13 wherein:

said base member has a side edge portion extending between said inner and outer sides, and said undercut slot opens outwardly through said side edge portion.

15. The apparatus of claim 13 wherein:

said undercut slot has an inner end configured to complementarily engage a side edge surface area of said head portion of said bolt in a manner inhibiting rotation of said bolt about its longitudinal axis relative to said base member.

16. The apparatus of claim 10 wherein:

said first opening is positioned to underlie said second opening when said wear member is mounted on said base member.

17. The apparatus of claim 16 wherein:

said nut is a conical locking nut having a tapered annular side surface, and said second opening has a tapered annular portion positioned and configured to be forcibly and complementarily engaged by said tapered annular side surface of said conical locking nut when said conical locking nut is operatively threaded onto said bolt with said wear member mounted on said base member.

18. The apparatus of claim 10 wherein:

said wear member has an outer side, and an inner side with a wear indicator recess formed therein.

19. Material handling apparatus comprising:

a surface subject to wear during use of said material handling apparatus; and a wear runner assembly mounted on said surface and operative to protect a portion thereof from wear, said wear runner assembly including:

a base member having an inner side secured to said surface, an outer side opposite said inner side, a peripheral side portion extending between said inner and outer sides, and an undercut slot longitudinally extending inwardly through said peripheral side portion parallel to said surface, a wear member mounted on said base member, said wear member being mountable on said base member by moving said wear member transversely toward said outer side of said base member, said base member having an opening formed therein and overlying said undercut slot, and a fastening structure positioned entirely outwardly of said surface and releasably holding said wear member on said base member, said fastening structure including:

a bolt having a head portion captively retained in said undercut slot, and a body portion extending through said slot into said wear member opening, said head portion being moveable into and out of said slot parallel to said surface when said wear member is removed from said base member, and a nut disposed within said wear member opening and threaded onto said body portion of said bolt, said base member and said wear member having releasably interlocked portions preventing appreciable movement of said wear member relative to said base member parallel to said surface in a manner causing said wear member to impose shear stress on said body portion of said bolt.

20. The material handling apparatus of claim 19 wherein:

said material handling apparatus is an excavating bucket.

* * * * *

UNITED STATES PATENT AND TRADEMARK OFFICE

CERTIFICATE OF CORRECTION

PATENT NO. : 6,041,529
DATED : March 28, 2000
INVENTOR(S) : John A. Ruvang

It is certified that error appears in the above-identified patent and that said Letters Patent is hereby corrected as shown below:

Column 6,
Line 4, delete "means" and insert -- structures -- in place thereof.

Signed and Sealed this

Fourth Day of February, 2003

JAMES E. ROGAN
*Director of the United States Patent and Trademark Office*